US005350341A

United States Patent [19]

Wolscht

[11] Patent Number: 5,350,341

[45] Date of Patent: Sep. 27, 1994

[54] INFANT FLAG ENCLOSURE

[76] Inventor: Maria S. T. Wolscht, RR #1 Catering Rd., Sutton, Ontario, Canada, L0E 1R0

[21] Appl. No.: 98,040

[22] Filed: Jul. 28, 1993

[51] Int. Cl.[5] ..... A63B 9/00; A63B 17/00

[52] U.S. Cl. ..... 482/35; 5/658

[58] Field of Search ..... 446/478, 476, 112; 5/93.1, 93.2, 658, 465, 900.5, 922, 98.1; 482/35; 280/79.2

[56] References Cited

U.S. PATENT DOCUMENTS

| | | | |
|---|---|---|---|
| 3,318,612 | 5/1967 | Kuhn | 280/79.2 |
| 3,737,161 | 6/1973 | Taylor et al. | 482/35 |
| 4,890,346 | 1/1990 | Rist | 5/922 |
| 5,162,010 | 11/1992 | Krebs | 446/112 |
| 5,163,195 | 1/1992 | Hill | 5/922 |

*Primary Examiner*—Richard J. Apley
*Assistant Examiner*—Jerome Donnelly
*Attorney, Agent, or Firm*—Hugh E. Smith

[57] ABSTRACT

An infant play enclosure adapted to safely hold and entertain infants from just after birth up to about 24 months in age which comprises an enclosure consisting of four wall members and a floor member detachably secured one to the other, means separating such enclosure into two areas, one adapted for newborns and designed to contain the infant until it is at the crawling stage and the other designed as a play area which becomes accessible to the infant after minimal motor skills are developed.

3 Claims, 3 Drawing Sheets

INFANT FLAG ENCLOSURE

BACKGROUND OF THE INVENTION

1. Field of the Invention

The present invention relates to infant play enclosures and more particularly pertains to such enclosures which may be termed a "dream gym".

2. Description of the Prior Art

The use of infant playpens is known in the prior art. More specifically, such items heretofore devised and utilized for the purpose of confining infants are known to consist basically of familiar, expected and obvious structural configurations, notwithstanding the myriad of designs encompassed by the crowded prior art which have been developed for the fulfillment of countless objectives and requirements. Usually such playpens are primarily designed to keep an infant confined with minimal entertainment or educational features involved. Examples are contained in U.S. Letters Pat. Nos. 4,900,011; 4,837,875; 4,669,138; 4,186,454; 4,008,499; and 3,430,273.

In this respect, the infant dream gym according to the present invention substantially departs from the conventional concepts and designs of the prior art, and in so doing provides an enclosed play area for infants primarily developed for the purpose of helping infants to develop gross motor skills.

Therefore, it can be appreciated that there exists a continuing need for new and improved infant enclosure which can be utilized to develop specific skills in the infant. In this regard, the present invention substantially fulfills this need.

SUMMARY OF THE INVENTION

In view of the foregoing disadvantages inherent in the known types of infant enclosures now present in the prior art, the present invention provides an improved infant dream gym construction wherein the same can be utilized to promote the development of motor skills in an infant. As such, the general purpose of the present invention, which will be described subsequently in greater detail, is to provide a new and improved infant enclosure which has all the advantages of the prior art playpens and none of the disadvantages.

To attain this, the present invention essentially relates to an infant dream gym adapted to safely hold and entertain infants from just after birth up to about 24 months in age which comprises an enclosure consisting of four wall members and a floor member detachably secured one to the other, means separating such enclosure into two areas, one adapted for newborns and designed to contain the infant until it is at the crawling stage and the other designed as a play are which becomes accessible to the infant after minimal motor skills are developed.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant enclosure which has all the advantages of the prior art constructions and none of the disadvantages.

It is another object of the present invention to provide a new and improved infant dream gym which may be easily and efficiently manufactured and marketed.

It is a further object of the present invention to provide a new and improved infant dream gym which is of a durable and reliable construction.

An even further object of the present invention is to provide a new and improved infant dream gym which is susceptible of a low cost of manufacture with regard to both materials and labor, and which accordingly is then susceptible of low prices of sale to the consuming public, thereby making such devices economically available to the buying public.

Still another object of the present invention is to provide a new and improved infant enclosure designed to encourage the infants' motor skills.

Yet another object of the present invention is to provide a new and improved infant enclosure suitable for newborns and up to two-year olds.

Even still another object of the present invention is to provide a new and improved infant dream gym which is safe for 0 to 24 month olds.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2:
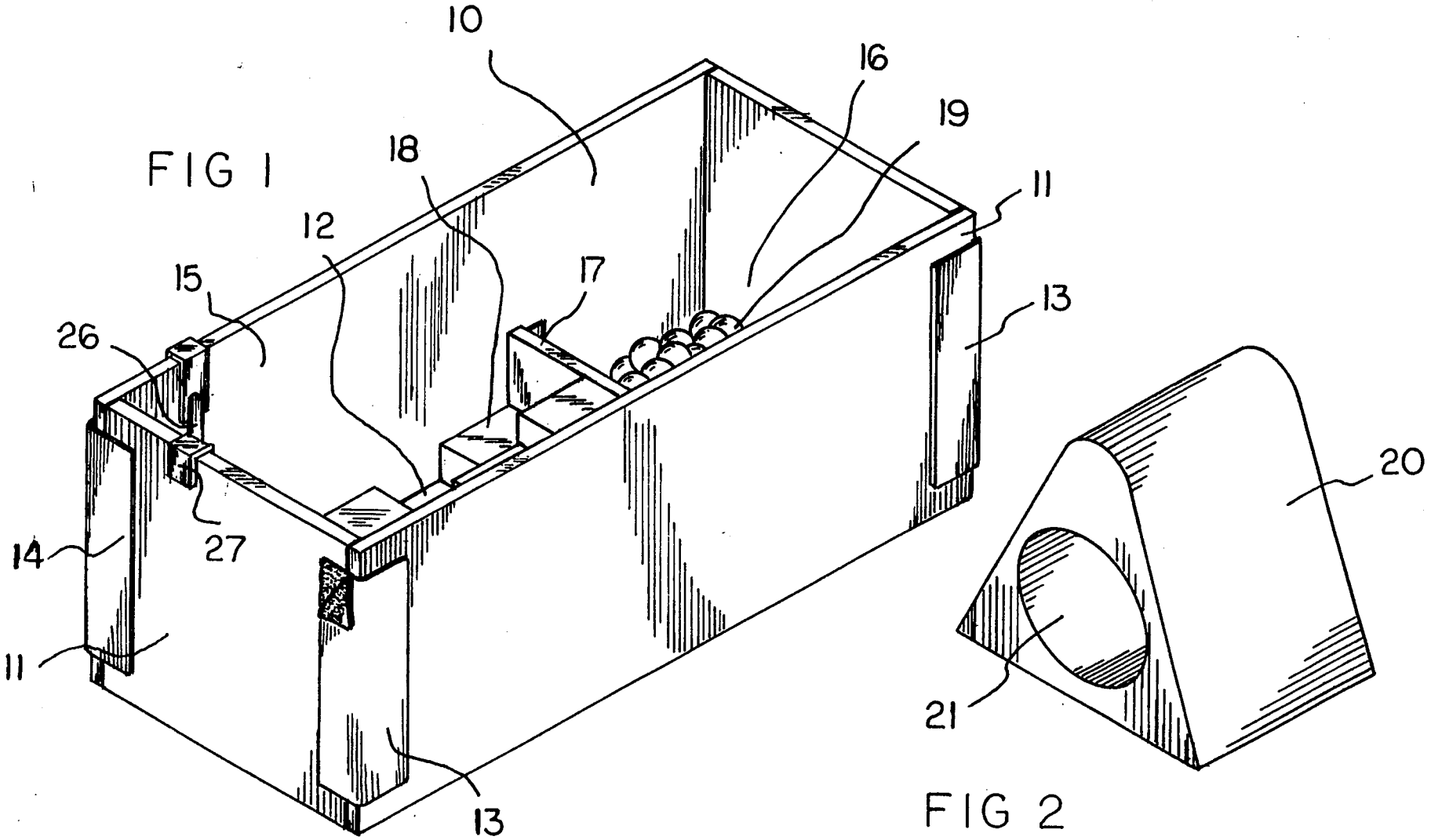
FIG. 1 is a perspective view of the infant dream gym of the present invention.
FIG. 2 is a perspective view of an insert used with the enclosure of FIG. 1.

With reference now to the drawings, and in particular to FIG. 1 thereof, a new and improved infant dream gym embodying the principles and concepts of the present invention and generally designated by the reference numeral 10 will be described.

The enclosure 10, i.e. the infant dream gym, is designed to be easily erected and knocked-down as described below. It comprises four walls 11 and a floor member 12. Secured to the exterior of wall 11 and to the floor member 12 are a plurality of flexible hook and loop fastener members 13 adapted to secure the walls 11 to each other and to the floor member 12. Preferably the wall members 11 forming the sides of the enclosure 10 have flaps of such closure material 14 long enough to wrap around the joint between the side and end walls and to secure to a mating piece of such closure material secured to the end walls and to the floor member 12. By virtue of this construction, the gym 10 may readily be expanded by inserting additional walls and the parts may readily be disassembled and piled one upon the other for movement or storage. The interior of enclosure 10 is divided into two compartments, one of which 15 is designated as a new-born area. The other compartment 16 is designated as a play area. Separating these two areas 15 and 16 is a low wall divider member 17. Leading up to the wall member 17 from the new-born area 15 is a plurality of step members 18 as more clearly shown in FIG. 3. The play area 16 contains a plurality of soft, resilient small diameter balls 19 (large enough in diameter that an infant could not fit one into its mouth). The walls 11, floor 12 and step members 18 are all made of sturdy, resilient foam material, e.g. closed cell polyurethane foam, and are in sufficient thickness to be compression resistent while still providing a soft surface which will not harm a child if it falls down thereon. Preferably such foam structures are encased in a flexible, washable plastic such as vinyl to protect the foam and to provide additional padding for the child. Additional padded layers may be utilized between the foam and the vinyl covering if desired.

Additional removable devices similarly constructed may be provided as toys for use within the enclosure 10, specifically as in FIG. 2, a triangular shaped foam construction 20 having an opening 21 extending therethrough to provide a tunnel for a child to crawl through.

Figures 3, 4, 5:
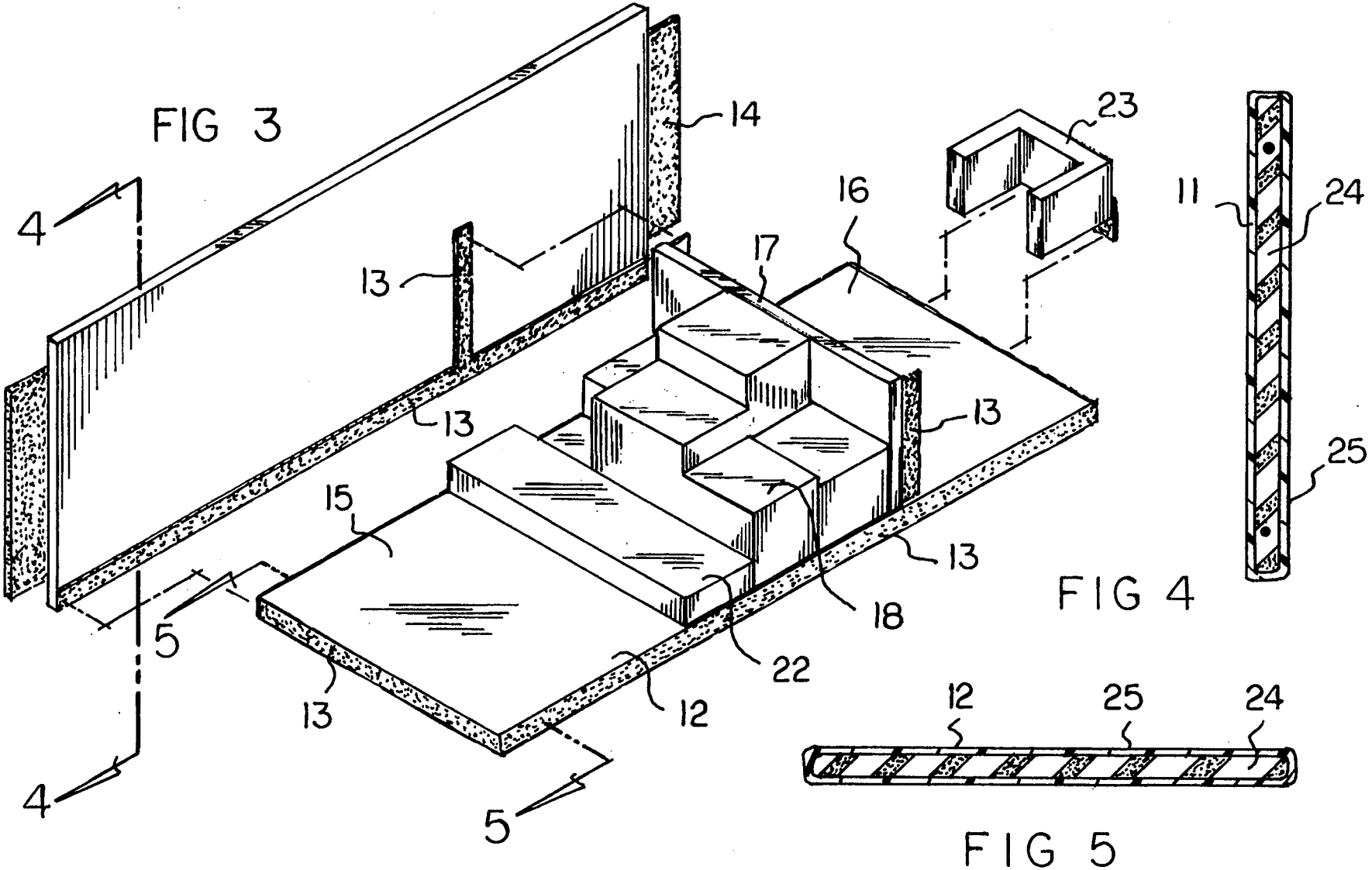
FIG. 3 is an exploded view of the structure of FIG. 1, illustrating both construction and the manner in which it can be disassembled for movement or storage.
FIG. 4 is a sectional view of a wall construction taken on line 4—4 of FIG. 3.
FIG. 5 is a sectional view of the floor member taken on line 5—5 of FIG. 3.

FIG. 3 illustrates the construction of the infant dream gym of FIG. 1 in greater detail. The wall 11 is shown with the hook and loop fastener members 13 thereon as is the floor member 12. Divider wall member 17 dividing the enclosure 10 into the two areas 15 and 16 is also shown as having the closure material 13 thereon to fasten to the walls 11 and floor 12. Step members 18 likewise fasten to the floor 12 with such closure material 13. With reference to such step members 18 it will be noted that the initial step 22 leading from newborn area 15 towards divider wall 17 is very low and wide relative to the other step members 18. This initial step 22 is designed for a beginning crawler, i.e. four to eight months, to pull up on from its knees. Once this challenge is met, the infant will eventually be able to get up the remaining step members 18. At this stage, the child will be able to pass over divider wall 17 and into the play area 16 filled with the soft balls 19. As a precaution, such balls are only one or two layers deep to protect the child from being buried therein. An addition to either area 15 or 16 as desired is a small seat 23 adapted to be fastened to the floor 12 (again with closure material 13). Such seat 23 preferably has sides and a back but no seat, utilizing the padded floor 12 as such.

FIGS. 4 and 5 illustrate respectively in cross-section the wall 11 construction and the construction of floor 12. In both instances, an inner core 24 of foam material of sufficient thickness and density as to be self-sustaining and compression resistant is covered by a protective plastic film 25 bonded to such foam.

Figure 6:
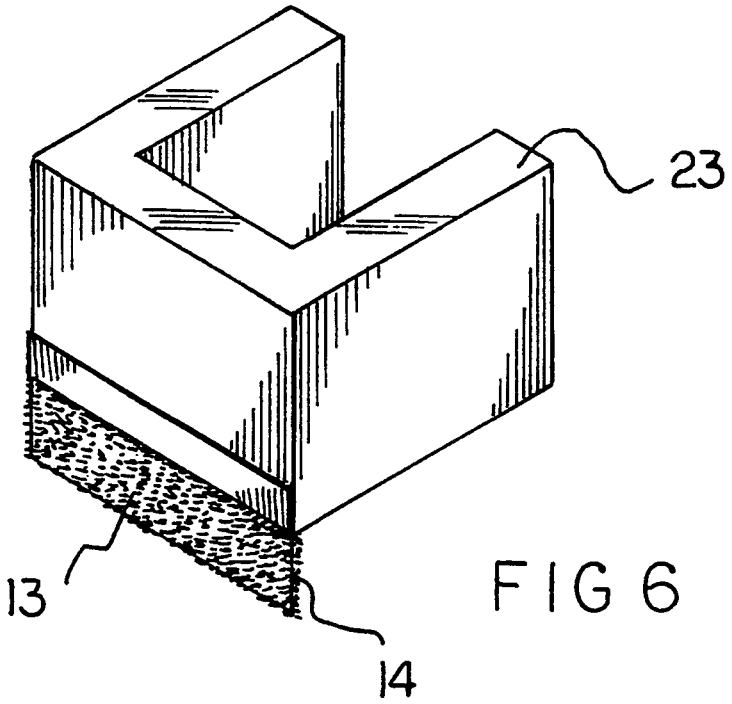
FIG. 6 is a perspective view of a seat prior to installation in the structure of FIG. 1.

FIG. 6 illustrates in more detail the seat 23 referred to in connection with FIG. 3. Again constructed in the same manner as walls 11 and floor 12 (see FIGS. 4 and 5), the base of the seat has a closure fastener member 14 formed of the hook-loop material which will fasten to the mating material on the edge of floor member 12.

Figure 7:
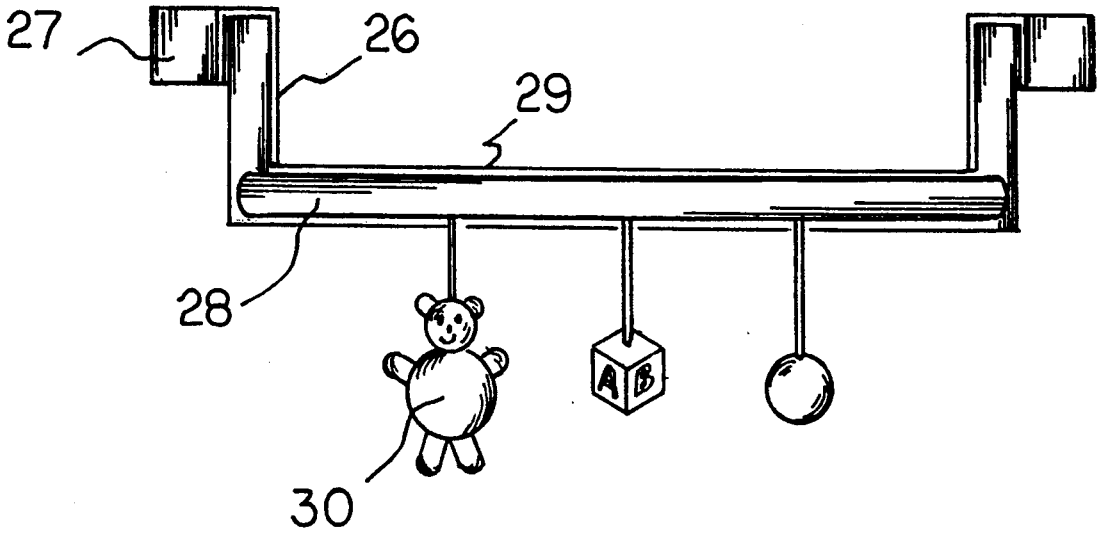
FIG. 7 is a depending bar shown in less detail in FIG. 1.

FIG. 7 illustrates the bar member 26 (barely visible in FIG. 1). Adapted to depend from walls 11 by U-shaped clamp members 27, bar 26 is a rigid bar 28 covered with soft padding 29 and adapted to support a plurality of small, colorful soft toys 30 hanging downwardly therefrom. This bar member 26 is designed to be removable, once the child is able to stand up and walk by holding onto the side walls 11, to afford more space within the enclosure 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. For example, various other shapes and types of padded foam constructions can be used as removable toys therein, short foam pegs may be affixed to the walls adjacent the steps to hang small toys therefrom, and, to extend the use to older children, a circular door could be cut into one wall (temporarily closed with a cover until the child was old enough) to permit use as a play house.

What is claimed as being new and desired to be protected by LETTERS PATENT of the United States is as follows:

1. An infant dream gym adapted to safely hold and entertain infants from just after birth up to at least twenty-four months of age, said dream gym comprising incombination:

an enclosure formed of four separate walls and a floor, said enclosure including means for releasably securing said walls to said floor and said walls to each other to define said enclosure, said walls and floor being comprised of a sturdy resilient foam material and a washable plastic film coating covering the surfaces of said foam, said enclosure being free standing a divider wall of substantially lower height than said four walls separating said enclosure into two areas to define a first area and a second areas, said divider wall being releasably secured to the walls and floor of said enclosure a plurality of raised padded steps releasably secured to said floor of said enclosure within one of said first or second areas, one of said steps being low relative to remaining said steps to permit an infant to pull up thereon prior to developing the capability of climbing said steps.

2. An infant dream gym as in claim 1, wherein said means for releasably securing said walls to said floor to define said enclosure comprises a plurality of flexible hook and loop fasteners.

3. An infant dream gym as in claim 2, and further comprising a seat adapted to be fastened to said floor, said seat consisting of sides coupled to a back.

* * * * *